US006132807A

United States Patent [19]

Hess et al.

[11] Patent Number: 6,132,807

[45] **Date of Patent: *Oct. 17, 2000**

[54] METHOD OF DIRECTLY OR INDIRECTLY APPLYING A LIQUID OR PASTY MEDIUM TO A CONTINUOUS MATERIAL WEB SO THAT SAID MEDIUM ON SAID WEB HAS A PREDETERMINED TRANSVERSE AND/OR LONGITUDINAL PROFILE

[75] Inventors: Harald Hess, Grünkraut; Hans-Peter Sollinger, Heidenheim, both of Germany

[73] Assignee: Voith Sulzer Papiermaschinen GmbH, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/130,267

[22] Filed: Aug. 6, 1998

[30] Foreign Application Priority Data

Aug. 7, 1997 [DE] Germany ..... 197 34 262

[51] Int. Cl.[7] ..... B05D 3/12

[52] U.S. Cl. ..... 427/356; 118/126; 118/413

[58] Field of Search ..... 427/356; 118/126, 118/413

[56] References Cited

U.S. PATENT DOCUMENTS

| | | | |
|---|---|---|---|
| 3,080,847 | 3/1963 | Justus | 118/126 |
| 3,081,191 | 3/1963 | Smith et al. | 118/413 |
| 3,453,137 | 7/1969 | Penkala et al. | 118/126 |
| 3,749,054 | 7/1973 | Brezinski | 118/126 |
| 3,996,889 | 12/1976 | Otten et al. | 118/126 |
| 4,133,917 | 1/1979 | Wallsten . | |
| 4,257,343 | 3/1981 | Kullander | 118/126 |
| 4,309,960 | 1/1982 | Waldvogel . | |
| 4,732,776 | 3/1988 | Boissevain . | |
| 5,529,629 | 6/1996 | Beisswanger . | |
| 5,735,956 | 4/1998 | Ueberschaer et al. | 118/410 |
| 5,785,253 | 7/1998 | Ueberschär et al. . | |

FOREIGN PATENT DOCUMENTS

| | | |
|---|---|---|
| 0570733 | 11/1993 | European Pat. Off. . |
| 0617168 | 9/1994 | European Pat. Off. . |
| 0701022 | 3/1996 | European Pat. Off. . |
| 0829575 | 3/1998 | European Pat. Off. . |
| 2913421 | 4/1979 | Germany . |
| 3036274 | 6/1980 | Germany . |
| 3120716 | 12/1982 | Germany . |
| 1458145 | 11/1974 | United Kingdom . |
| 1458145 | 12/1976 | United Kingdom . |
| 9403282 | 2/1994 | WIPO . |

OTHER PUBLICATIONS

Translation of claim 1 of DE OS 26 37 827, (no date).

Translation of claim of DE OS 29 15 300, (no date).

Translation of claim 1 of DE OS 34 19 277, (no date).

Translation of claim 1 of EP 0 829 575, (no date).

Translation of claim 1 of DE OS 31 20 716, (no date).

*Primary Examiner*—Katherine A. Bareford
*Attorney, Agent, or Firm*—Ostrolenk, Faber, Gerb & Soffen, LLP

[57] ABSTRACT

The invention relates to a method of directly or indirectly applying a liquid or pasty medium to a continuous material web by use of an application unit having at least one applicator, at least one doctor element, and at least one doctor element support at which the doctor element is held and can be pressed at a predetermined pressure against a counter-surface by at least one adjustment movement of the doctor element support. The following steps are usable to set a desired transverse and/or longitudinal profile of the medium to be applied or which has been applied: pressing the doctor element at a predetermined contact pressure against the counter-surface by adjusting the doctor element support into a predetermined adjustment position, and by altering the forces exerted on the doctor element by the medium to be applied or which has been applied, while the adjustment position of the doctor element support is kept constant for a predetermined production range.

15 Claims, 1 Drawing Sheet

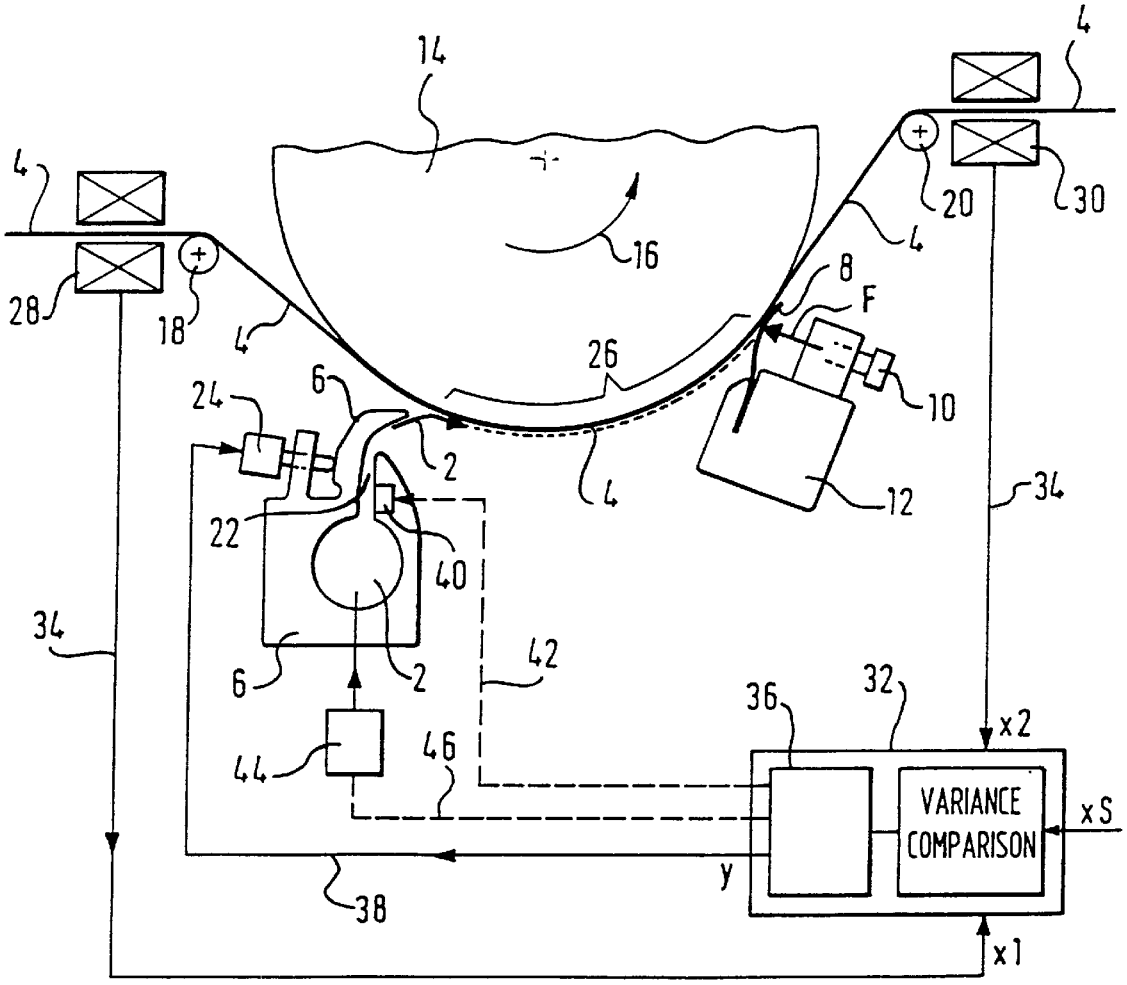
14
16
4
28
18
20
30
8
F
10
12
26
24
6
2
22
40
42
44
46
34
36
32
x2
VARIANCE
COMPARISON
xS
y
38
x1

METHOD OF DIRECTLY OR INDIRECTLY APPLYING A LIQUID OR PASTY MEDIUM TO A CONTINUOUS MATERIAL WEB SO THAT SAID MEDIUM ON SAID WEB HAS A PREDETERMINED TRANSVERSE AND/OR LONGITUDINAL PROFILE

BACKGROUND OF THE INVENTION

1. Field of the Invention

The present invention relates to a method of directly or indirectly applying a liquid or pasty medium to a continuous material web.

2. Related Art

Methods according to the class described above are, in practice, performed as part of so-called coating plants in order to provide one or both sides of a continuous material web, composed for example of paper, cardboard or a fabric material, with one or more layers of the medium, for example ink, starch, impregnating fluid or the like.

So-called direct application involves an applicator applying the liquid or pasty medium directly onto the surface of the continuous material web supported during application on a revolving counter-surface, such as an endless belt or a counter-roll. Indirect application of the medium, on the other hand, first involves applying the liquid or pasty medium onto a carrier surface, e.g. the surface of a counter-roll designed as an application roll, from where, in a roll gap through which the material web passes, it is transferred by the application roll to the material web.

The "Paper Maker's Pocket Book", March 1993 edition, pp. 206 and 207, Section 5.7.2.3.5, describes a method according to the class for directly or indirectly applying a liquid or pasty medium to a continuous material web; in this method, a desired transverse and/or longitudinal profile of the medium to be applied or which has been applied is set by means of an application unit (here: a so-called smoothing scraper type coating device) which comprises an applicator, a doctor element, e.g. a doctor knife or a scraper blade, downstream of the applicator, and a doctor element support fixed to a pivotable support or doctor beam and co-pivotable therewith. The doctor element is held on this support. For this purpose, the doctor element is moved into a predetermined adjustment position by pivoting the entire support beam and the doctor element support attached thereto and pressed at a predetermined contact pressure against a continuous counter-surface, e.g. the surface of an application roll or the surface of the material web itself. The applicators used in conjunction with such a process are also usually equipped with one or more actuators distributed over the applicator's longitudinal extension, e.g. mechanical, electrical, electromagnetic, hydraulic or pneumatic actuators and the like, which are attached to the support beam and act upon the doctor element evenly across substantially the entire material web width or zonally to varying extents for the precision adjustment of the contact pressure exerted on the doctor element, thereby enabling the (precision) adjustment of the transverse and/or longitudinal profile, regardless of the setting of the support beam itself. Not only due to the ever present manufacturing inaccuracies of the applicator and the material web to be coated, not to mention doctor element wear and the associated local variations in doctor element contact pressure against the coated counter-surface, but also due to changing operational and production conditions, it is nevertheless necessary to correct the transverse and/or longitudinal profile continuously. This is done in the known method by altering the originally chosen support beam adjustment position and/or as a result of evenly or unevenly altering the forces exerted upon the doctor element by the actuators. In other words, the support beam adjustment position or the actuating positions of the actuators which act upon the doctor element are permanently re-adjusted during the application unit's continuous operation. It is evident that this method not only requires considerable outlay in terms of control technology and structural design, entailing a number of complex and expensive actuators, and hence is quite cost-intensive, but also leads to problems in terms of reproducibility of the settings selected for specific operating conditions and parameters.

It should be noted that the aforementioned method is in principle applied both for the "stiff blade approach" and for the "bent blade approach". The stiff blade technique involves a doctor element, which usually has an inclined edge on its contact surface, being pressed at a specific working or doctor angle against the counter-surface to be doctored and this angle is also usually retained when a change in contact pressure is needed to correct the coating weight or the transverse and/or longitudinal profile. The bent blade technique, on the other hand, involves pressing an elastically deformable doctor element, normally a doctor knife, at a smaller angle against the counter-surface to be doctored and varying the contact pressure and/or the working or knife angle, depending on the coating weight required. In the stiff blade technique, the knife angle is usually approx. 25–45° and in the bent blade technique approx. up to 25°. The settings mentioned should, however, only be understood as rough reference values.

The problems described above in conjunction with the reproducibility of the adjustments to be selected for specific operating conditions and parameters are particularly serious in the aforementioned bent blade approach with regard to the coating quality to be achieved.

DE 29 13 421 B2, DE 30 362 74 C2 (which corresponds to the subject matter of this document) and WO 94/03282 disclose a method of applying a liquid or pasty medium to a continuous material web; this method substantially corresponds to the well-known process described at the outset, but instead of the entire support or doctor beam, just a correspondingly adjustable doctor knife support is pivoted.

A method according to the class is also known from EP 0 617 168 A1. In this method, an entire metering device of the applicator, at which there is fixed a doctor element to be operated in the bent blade mode, is analogously pivotable and adjustable instead of the support or doctor beam or a correspondingly pivotable doctor knife support. Separate actuators are in turn provided for the precise adjustment of the longitudinal and/or transverse profile.

SUMMARY OF THE INVENTION

The present invention is based upon the object of providing a method according to the class which avoids the disadvantages affecting the prior art as much as possible and which enables good reproducibility of a setting selected for specific operating conditions and parameters.

The aforementioned object may be solved by a method according to the invention as disclosed and claimed herein.

This method of directly or indirectly applying a liquid or pasty medium to a continuous material web, particularly one made of paper or cardboard, by means of an application unit having at least one applicator, at least one doctor element, and at least one doctor element support at which the doctor element is held and can be pressed at a predetermined contact pressure against a counter-surface by means of at least one adjustment movement of the doctor element, comprises the following steps in order to set a desired transverse and/or longitudinal profile of the medium to be applied or which has been applied:

a) pressing the doctor element at a predetermined contact pressure against the counter-surface by adjusting the doctor blade support into a predetermined adjustment position, and b) altering the forces exerted on the doctor element by the medium to be applied or which has been applied, while the adjustment position of the doctor element support is kept constant (within a certain production range), such as by changing the viscosity (or other characteristics) of the medium.

In addition, if knives are used as doctor elements, the working angle thereof may be adapted to the altered action of force.

The method according to the invention can generally be realized using any suitable application unit, for example a nozzle or free-jet nozzle type application unit, a roll or scoop roll type application unit which may belong to the group of "long dwell time applicators", or using an application unit that has an application chamber or pressurized application chamber, e.g. a "short dwell time applicator", etc., equipped with corresponding applicators or metering devices (pre- and/or final metering devices). The method according to the invention can in principle be designed with any suitable doctor elements, though particularly with doctor elements that can be operated in the bent-blade or stiff-blade mode, such as elastically deformable doctor or scraper knives, or even roller doctor elements, doctor bars with a smooth and/or coarse surface or profiled doctor bars disposed on an elastically deformable knife-like doctor support or a doctor support with inherently elastic properties. These doctor elements are preferably designed to be highly resistant to wear, such as by using recast-hardened or nitrated materials or by attaching a wear-resistant coating, e.g. a ceramic coating. The adjustable doctor element support may relate either to an adjustable support or doctor beam at which the doctor element is directly fixed, or to a doctor-element securing or retaining device arranged on a mobile or immobile support or doctor beam and which can be adjusted relative thereto. A counter-surface should be defined as either a continuous application roll surface in the case of indirect application, the continuous material web surface itself in the case of direct application or even a stationary counter-surface. A medium to be applied characterizes one which has not yet made contact with the surface to be coated (e.g. the surface of an application roll or the material web surface), whereas an applied medium already adheres to the surface to be coated or makes contact therewith.

In contrast to the prior art in which the originally selected predetermined adjustment position of the doctor element support is subject to permanent alteration during continuous operation for the purpose of re-adjusting the contact pressure or the working angle of the doctor element, the adjustment position which is predetermined once for given requirements (i.e. for example: the adjustable doctor beam's predetermined pivoting angle and the doctor element's resultant predetermined bias) is, in the case of the method according to the invention, left unchanged for a defined production range (a position which is altered as a result of doctor element wear and relative to the counter-surface, and an associated change in contact pressure and/or knife angle are therefore permitted in contrast to the prior art), while an alteration of the forces exerted on the doctor element by the medium to be applied or which has been applied takes place. In other words, a change in the geometry of the doctor element, i.e. an even and/or locally varying deformation of the doctor element or its support, is not brought about by the effect of one or more actuators making direct or indirect contact with the doctor element or by adjusting an external contact pressure system, but by the effect of the medium itself upon the doctor element. In accordance with the invention, various suitable options are made available for this kind of manipulation of the doctor element and hence of the transverse and/or longitudinal profile; these options will be explained in more detail below.

It is evident that in the method according to the invention, it is possible to dispense with the expensive actuators or contact pressure systems required in conventional techniques as well as to dispense with the related control and monitoring devices, and that the structural design and production outlay, particularly as regards a support or doctor beam acting as a doctor element support, can therefore be considerably reduced while simultaneously reducing the production costs for the application unit used in conjunction with the process according to the invention. As a result of the application unit's simplified construction, this unit is also easier to operate, particularly in terms of handling and servicing the doctor element support or support beam. It has also been shown that the process according to the invention leads to very good reproducibility of a setting chosen for specific operating and production conditions and parameters, particularly in the doctor element's bent blade mode, and hence results in an absolutely top-quality final product, since unlike the conventional application processes described at the start, the influence of doctor element wear and —if a doctor knife is used, for example—the resultant change in knife angle and original knife contact pressure can be largely eliminated.

According to an advantageous embodiment of the method according to the invention, the forces exerted on the doctor element by the medium to be applied or which has been applied are varied evenly across substantially the entire machine width and/or to zonally varying extents. In this way, both the longitudinal and the transverse profile of the achieved application is adjustable if need be.

In a preferred embodiment of the invention, the change in those forces exerted on the doctor element by the medium to be applied or which has been applied is brought about by varying the medium's viscosity. For this purpose, the medium can for example be heated and/or cooled evenly across substantially the entire web width or to zonally differing extents both before and after application, though in any case before the modified section of medium passes through the doctor element. To do so, corresponding cooling or heating devices are provided on the application unit used in conjunction with the process according to the invention. These devices can be arranged on an applicator or metering device of the application unit, for instance in the nozzle slot of a nozzle application unit or at a distance from a material-web or application-roll portion already coated with the medium, and preferably extend across substantially the entire machine width. Viscosity can also be varied e.g. by (locally) altering the solid content and/or by a (zonally) varying concentration of ingredients that exhibit a thickening effect. In accordance with the varyingly viscous sections of medium, the medium brings about a varying effect of force upon the doctor element and hence a corresponding deformation of same, which can in turn be used indirectly to set a transverse and/or longitudinal profile. Although the procedural step of varying the medium's viscosity can also be applied in order to modify a transverse profile, it is preferably used to set a longitudinal profile in combination with a nozzle application unit or a roll application unit. Unlike the prior art, it is possible to influence the medium and doctor element in the aforementioned manner without mobile actuators or actuator mechanisms, thus allowing the associated application unit's design to be simplified and easier to maintain, with easily manageable control technology.

In another preferred embodiment feature of the method according to the invention, it is in turn envisaged that the change in those forces exerted upon the doctor element by the medium to be applied or which has been applied should be brought about by varying the medium's solid content.

Another advantageous version of the invention envisages that the change in those forces exerted on the doctor element by the medium to be applied or which has been applied is brought about by varying the metering amount of the medium to be applied. This is particularly simple to implement in terms of processing technology.

According to another aspect of the invention, the change in those forces exerted on the doctor element by the medium to be applied or which has been applied can also be advantageously brought about by varying the pressure of the medium to be applied. In doing so, it is possible to alter both the static and the dynamic pressure of the medium in a suitable manner.

In accordance with another positive embodiment of the method described by the invention, the change in those forces exerted on the doctor element by the medium to be applied or which has been applied is brought about by varying the applicator's geometry. The metering amount and/or the static or dynamic pressure of the medium can again be altered as a result. If a nozzle application unit is for example used as an applicator, the desired effect of force might be achieved by adjusting the nozzle gap geometry evenly across the entire web width or to a locally varying degree. If there are other configurations, it is equally conceivable for the geometry of a return gap or the gap between the application unit and the counter-roll etc. to be altered. At this point, it should again be pointed out that once the doctor element's initial position has been pre-set, it nevertheless remains unchanged.

Finally, according to another advantageous embodiment of the method described by the invention, the change in those forces exerted on the doctor element by the medium to be applied or which has been applied can be brought about by varying the medium's dwell time between an application zone of the applicator and the doctor element.

BRIEF DESCRIPTION OF THE DRAWING

A preferred exemplary embodiment of the method according to the invention that comprises additional design details will be more closely described and explained below with reference to the attached drawing.

The sole FIGURE shows a schematic, highly simplified side view of a device used to perform the method according to the invention.

DETAILED DESCRIPTION

In the present case, the method is designed as a method of directly applying a liquid or pasty medium 2 to a continuous material web 4 and is performed by means of an application unit that comprises a free-jet nozzle type applicator 6, a flexurally elastic doctor knife 8 provided with a wear-resistant ceramic coating and located downstream of the free-jet nozzle type applicator 6, a doctor element support 12 adjustable via actuator means 10 and on which the doctor knife 8 is held, and a counter-roll 14. The counter-roll 14 rotates in the direction indicated by the arrow 16 and supports, on its surface along a support portion, the material web 4. The direction of movement of the material web 4 is also specified by the direction of rotation of the counter-roll 14. The material web 4 is fed via a web guide roll 18 at the leading end in relation to the free-jet nozzle type applicator 6, i.e. on the left-hand side of the FIGURE, and after coating, the material web 4 is removed from the application unit via a web guide roll 20 at the trailing end, i.e. on the right-hand side of the FIGURE. The free-jet nozzle type applicator 6 is assigned to the material web 4 to be coated in that region of the support portion in which the material web 4 is supported on the counter-roll 14. The free-jet nozzle type applicator 6 has a nozzle gap 22 with setting means 24 which allow the nozzle gap width to be set both evenly across substantially the entire material web width and to locally varying extents.

Starting from a standby position of the doctor knife 8, the following steps are then performed while the application unit is in continuous mode so as to set a desired transverse and/or longitudinal profile of the applied medium 2. The doctor knife 8 is first placed in a predetermined adjustment position by activating the actuator mechanism 10 of the doctor element support 12; in this position, it is pressed in the direction (F) against the continuous material web 4 at a predetermined contact pressure and in the present example in the bent blade technique. Once this basic setting is selected, it is left unaltered during further application mode, even when there is blade wear. If a transverse and/or longitudinal profile modification is to be performed, the forces exerted on the doctor knife 8 by the applied medium 2 (which thereby deforms the knife as a reaction to the applied medium) are then altered, while at the same time the original adjustment position of the doctor knife 8 is kept constant. In the present exemplary embodiment, this change in forces is brought about by an even or locally varying adjustment of the nozzle gap width of the applicator 6 by way of the setting means 24, which in turn results in an even or locally varying change in the amount of medium 2 applied in the region of the material web portion 26 leading to the doctor knife 8. If the material web portion 26 coated in this manner now passes through below the doctor knife 8, those regions coated to quantitatively varying degrees, adhering to the material web portion 26 and which also have a different linear momentum exert a varying effect of force upon the doctor knife 8 and deform it to correspondingly varying extents, thereby modifying the doctor behavior of the doctor knife 8 and producing a specific longitudinal or transverse profile via the reaction of the doctor knife to the applied medium.

As regards accurately changing—in a manner precisely adapted to the particular procedural parameters—those forces exerted upon the doctor knife 8 by the applied medium 2, the application unit used in conjunction with the method according to the invention expediently has suitable control and/or regulating means and corresponding sensors. As shown in the FIGURE, a control loop of the device comprises two measuring stations 28, 30, one 28 of which is upstream of the free-jet nozzle type applicator 6 and the other 30 is downstream of the free-jet nozzle type applicator 6, a computer unit 32 connected via lines 34 to the two measuring stations 28, 30, a control unit 36 integrated into the computer unit 32, and the nozzle gap width setting means 24 coupled via a line 38 to the output side of the control unit 36 or computer unit 32.

On the basis of the values from the measuring stations 28, 30 the computer unit 32 continuously receives the actual values x1, x2 for the transverse and/or longitudinal profile of the uncoated material web 4 and the coated material web 4. These actual values x1, x2 are compared with predetermined reference values xS for the transverse and/or longitudinal profile and are stored in the computer unit 32 or supplied thereto. Discrepancies between the actual values x1, x2 and the reference values xS are converted into corresponding control variables y which are forwarded via the control unit 36 and the line 38 to the setting means 24 where corresponding nozzle gap width readjustments, which are even across substantially the entire machine or material web width and/or which zonally vary, then take place. In this way, those forces exerted on the doctor knife 8 by the medium to be applied or which has been applied are altered evenly across substantially the entire machine width and/or to zonally varying extents, while the initial adjustment position (basic setting) of the doctor element support 12 is kept constant.

Although as described above, the change in those forces exerted on the doctor knife 8 by the medium 2 to be applied or which has been applied was brought about by varying the geometry of the applicator 6, i.e. its nozzle gap width, and by extension by varying the metering amount and pressure of the medium 2 to be applied, a corresponding effect can also be achieved by varying the viscosity and/or the solid content of the medium 2.

A change in the viscosity of the medium 2 can be made for example by temperature-regulating means 40 integrated into the free-jet nozzle type applicator 6 and comprising one or more heating and/or cooling elements, enabling the medium 2 to be heated and/or cooled evenly across substantially the entire machine width and/or to zonally varying extents. The temperature-regulating means 40 can be used either instead of the aforementioned nozzle gap adjustment or in addition thereto. It is also possible to incorporate the temperature-regulating means 40 into the control loop explained above, as depicted by broken lines 42.

The solid content of the medium 2 can for example be influenced by a solid content admixture means 44 corresponding to the free-jet nozzle type applicator 6 and comprising one or more admixture elements, causing the medium 2 to be correspondingly modified by even or zonally varying addition of suitable solids and causing those forces exerted on the doctor element 8 by the medium 2 to be applied or which has been applied to be altered in the sense according to the invention. The solid content admixture means 44 can also be used either instead of the above-described nozzle gap adjustment or in addition thereto. It is also possible to incorporate the solid content admixture means 44 into the control loop explained earlier on, as indicated by broken lines 46. Since a change in the solid content of the medium 2 does, of course, also affect its viscosity, the solid content admixture means 44 simultaneously represents a viscosity changing means.

The invention is not restricted to the above exemplary embodiment which merely serves to explain the invention's basic idea in general terms. On the contrary, as part of the scope of protection, the method according to the invention can also assume an embodiment other than that described above. The method may in particular comprise features which represent a combination of the respective individual features of the claims. It is also possible to bring about the initial positioning of the doctor element support into a predetermined adjustment position by the combined movement of an adjustable doctor beam and a doctor-element securing or retaining means attached thereto and adjustable relative to the doctor beam.

Reference symbols in the claims, specification and drawings merely serve to improve comprehension of the invention and are not intended to restrict the scope of protection.

LIST OF REFERENCE SYMBOLS

The following are designated:

2 Liquid or pasty medium
4 Material web
6 Free-jet nozzle type applicator
8 Doctor knife/Doctor element
10 Actuator for 8 or 12
12 Doctor element support
14 Counter-roll
16 Rotational direction of 14/Direction of movement of 4
18 Web guide roll, leading
20 Web guide roll, trailing
22 Nozzle gap
24 Setting means for 22
26 Coated material web portion, leading to 8
28 Measuring station
30 Measuring station
32 Computer unit
34 Lines
36 Control unit
38 Line
40 Temperature-regulating means
42 Control loop link of 40 (optional)
44 Solid content admixture means
46 Control loop link of 44 (optional)
F Contact pressure force
x1 Actual values
x2 Actual values
xS Reference values
y Control variables

What is claimed is:

1. A method of directly or indirectly applying a liquid or pasty medium to a continuous material web by an application unit having:

at least one applicator which applies said medium to said web, at least one doctor element which doctors said applied medium after it has been applied to said web, a counter-surface for supporting and guiding said web at said doctor element, and at least one doctor element support on which said doctor element is held, said doctor element support having a position, said doctor element support being adjustable for setting a predetermined contact pressure position of said doctor element against said counter-surface, the method comprising the following steps to set a desired transverse and/or longitudinal profile of said applied medium:

adjusting the position of said doctor element to press at a predetermined contact pressure against said counter-surface by adjusting said doctor element support into a predetermined position, applying said medium to said web, and before or while said medium is being applied to said web, altering forces which will be exerted on said doctor element for altering the geometry of the doctor element by varying the force applied by the medium to the doctor element and/or the manner at which said medium is applied to said web so as to effect said desired transverse and/or longitudinal profile of said applied medium on said web, while keeping the position of said doctor element support constant.

2. A method according to claim 1, comprising the step of altering the forces exerted on said doctor element by said medium evenly across substantially an entire width of said web.

3. A method according to claim 1, comprising the step of altering the forces exerted on said doctor element by said medium by varying the viscosity of said medium applied to said web.

4. A method according to claim 3, wherein said viscosity is varied by heating said medium.

5. A method according to claim 3, wherein said viscosity is varied by cooling said medium.

6. A method according to claim 3, wherein said viscosity is varied by varying a concentration of a thickening ingredient in said medium.

7. A method according to claim 3, wherein said viscosity is varied evenly across substantially an entire width of said web.

8. A method according to claim 3, wherein said viscosity is varied different respective amounts in corresponding zones across a width of said web.

9. A method according to claim 1, comprising the step of altering the forces exerted on said doctor element by said medium by varying the solid content of said medium applied to said web.

10. A medium according to claim 1, comprising the step of altering the forces exerted on said doctor element by said medium by varying the amount of said medium applied to said web.

11. A method according to claim 1, comprising the step of altering the forces exerted on said doctor element by said medium by varying the pressure at which said medium is applied to said web.

12. A method according to claim 1, wherein said applicator is a nozzle having a nozzle gap through which the medium is ejected onto said web, said method comprising the step of altering the forces exerted on said doctor element by varying a width of said nozzle gap.

13. A method according to claim 1, comprising the step of altering the forces exerted on said doctor element by said medium to different respective extents in corresponding zones across a width of said web.

14. A method according to claim 1, wherein said doctor element is disposed away from said applicator in a moving direction of said web.

15. A method according to claim 1, wherein said doctor element is disposed away from said applicator in a moving direction of said web, said method comprising the step of altering the forces exerted on said doctor element by said medium by varying a dwell time of the medium between an application zone of the applicator and the doctor element.

* * * * *